US008021065B2

(12) United States Patent
Lou

(10) Patent No.: US 8,021,065 B2
(45) Date of Patent: Sep. 20, 2011

(54) ELECTRICAL MASCARA BRUSH STRUCTURE WITH VARIABLE SPEEDS

(75) Inventor: Kun-Lan Lou, Changhua County (TW)

(73) Assignee: Jia Hsing Enterprise Co., Ltd., Changhua County (TW)

( * ) Notice: Subject to any disclaimer, the term of this patent is extended or adjusted under 35 U.S.C. 154(b) by 140 days.

(21) Appl. No.: 12/536,385

(22) Filed: Aug. 5, 2009

(65) Prior Publication Data

US 2011/0030716 A1 Feb. 10, 2011

(51) Int. Cl.
*A46B 11/00* (2006.01)

(52) U.S. Cl. ..... 401/129; 401/119; 401/118; 132/218; 132/216; 132/119.1; 15/25; 15/26; 15/34

(58) Field of Classification Search ..... 401/129, 401/119, 118; 132/218, 216, 119.1; 15/25, 15/26, 34
See application file for complete search history.

(56) References Cited

U.S. PATENT DOCUMENTS

| | | | | |
|---|---|---|---|---|
| 4,397,326 | A | 8/1983 | Formica | |
| 4,632,136 | A | 12/1986 | Kingsford | |
| 5,970,990 | A | 10/1999 | Dunton et al. | |
| 6,309,125 | B1 | 10/2001 | Peters | |
| 6,565,276 | B1 | 5/2003 | Diaz | |
| 7,165,906 | B2 * | 1/2007 | Dieudonat et al. | 401/127 |
| 7,465,114 | B2 | 12/2008 | Kress et al. | |
| 7,481,592 | B2 | 1/2009 | Gueret | |
| 2006/0032512 | A1 | 2/2006 | Kress et al. | |
| 2006/0090343 | A1 | 5/2006 | Riley et al. | |
| 2006/0272668 | A1 * | 12/2006 | Wyatt et al. | 132/218 |
| 2007/0186948 | A1 | 8/2007 | Kim et al. | |
| 2007/0297844 | A1 | 12/2007 | Gutberlet | |
| 2008/0210254 | A1 * | 9/2008 | Jeong et al. | 132/218 |
| 2008/0236608 | A1 | 10/2008 | Tranchant et al. | |
| 2008/0276955 | A1 * | 11/2008 | Neuner et al. | 132/218 |
| 2009/0000636 | A1 | 1/2009 | Marotta et al. | |
| 2009/0007928 | A1 | 1/2009 | Kress | |
| 2009/0007929 | A1 | 1/2009 | Kress | |

FOREIGN PATENT DOCUMENTS

| | | | |
|---|---|---|---|
| WO | 2006090343 | A1 | 8/2006 |
| WO | 2006132459 | A1 | 12/2006 |
| WO | 2007094552 | A1 | 8/2007 |

OTHER PUBLICATIONS

Unknown, New Pulse Perfection by Define-A-Lash Vibrating Mascara, Maybelline, New York, available at http://www.maybelline.com/Product/Eye/Mascara/Pulse-Perfection-Define-A-Line.htm, printed on Aug. 3, 2009, USA.

* cited by examiner

*Primary Examiner* — David J. Walczak
*Assistant Examiner* — Jennifer C Chiang
(74) *Attorney, Agent, or Firm* — Senniger Powers LLP

(57) ABSTRACT

An electrical mascara brush structure includes a brush body having a chamber to hold an electrical motion component at one end and a brush rod with a brush at the other end. The electrical motion component includes a first shell and a second shell fully enclosing a power supply, a motor with a rotating shaft, and a circuit board. The circuit board includes a power control element and a variable speed control element. The electrical motion component is connected with a rotary unit disposed at the external of the first shell and the second shell. The rotary unit includes external teeth which matches with receiving teeth disposed at an interior of a handle, which can activate the electrical motion component and adjust the speed of the motor.

17 Claims, 8 Drawing Sheets

ELECTRICAL MASCARA BRUSH STRUCTURE WITH VARIABLE SPEEDS

FIELD OF THE INVENTION

Embodiments of the invention relate generally to an electrical mascara brush structure. In particular, aspects of the invention include an electrical motion component that enables a user to adjust the vibrating speed of the mascara applicator when using the mascara applicator.

BACKGROUND OF THE INVENTION

Existing manually operated mascara applicators require a user to place a wand applicator inside a container that contains the mascara. After a brush on the wand includes sufficient mascara, the user next carefully rotates the wand applicator in a direction along the length of user's eyelashes to apply the mascara onto the user's eyelashes. For beginners or users with limited dexterity, the rotating motion of the user's wrist maybe difficult and cumbersome. This may result in not being able to apply the mascara to the eyelashes correctly or even apply the mascara onto other parts of the face, further complicated the process of applying makeup to the user's face.

In addition, other electrical wand applicators, such as ones disclosed in patent number M341438 of Taiwan, include a body with a circuit board, a power supply and a vibrator therein. However, if there is an external force or if the vibrating force from the vibrator is too great for a prolong period, the power supply or any individual components thereof may become loose and thus knocking against other components without any protection. Thus, the electrical wand applicators may become malfunction and inoperable.

Other electrical wand applicators require the user to continuously hold or depress an activation button during use. If the user removes her finger from the activation button due to fatigue, the vibration of the wand applicator stops and the user experience of the electrical wand applicator is less desirable. Other electrical wand applicators become activated when the user removes the wand from the container which contains the mascara, but it may waste electrical energy. Other electrical mascara applicators only have one vibration speed.

SUMMARY OF THE INVENTION

Aspects of the invention provide an electrical mascara brush structure. The electrical mascara brush structure includes a wand applicator having an electrical motion component with multi-level speed adjustments. As such, once activated, the electrical motion component causes the rod and the brush of the wand applicator to vibrate. The user can then bring the applicator near the eyelashes and, through the vibration, the user can apply the mascara to the eyelashes in a direction to make the eyelashes curl. This prevents or avoids the user to unevenly apply the mascara according to existing mascara applicators.

Embodiments of the invention provide the electrical motion component with a motor, a power supply, and a circuit board connected therewith to form an electrical loop circuit. The electrical motion component further includes a pair of complimenting shell which encloses the electrical motion component therein. Such an embodiment prevents or avoids shifting movements of the power supply or the circuit board caused by vibration of the motor. Such shifting movements may cause a short circuit or other electrical issues that may reduce the usable life of the applicator. In addition, aspects of the invention include a one integrated structure of the wand base and the wand, with the wand base creating a chamber to house at least partially the electrical motion component. This construction enables the wand applicator to have a more subtle vibration such that the wand shaft does not oscillate as violently as the bristles of the end brush.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter Further benefits and advantages of the present invention will become apparent after a careful reading of the detailed description with appropriate reference to the accompanying drawings.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF EMBODIMENTS OF THE INVENTION

Figure 1:
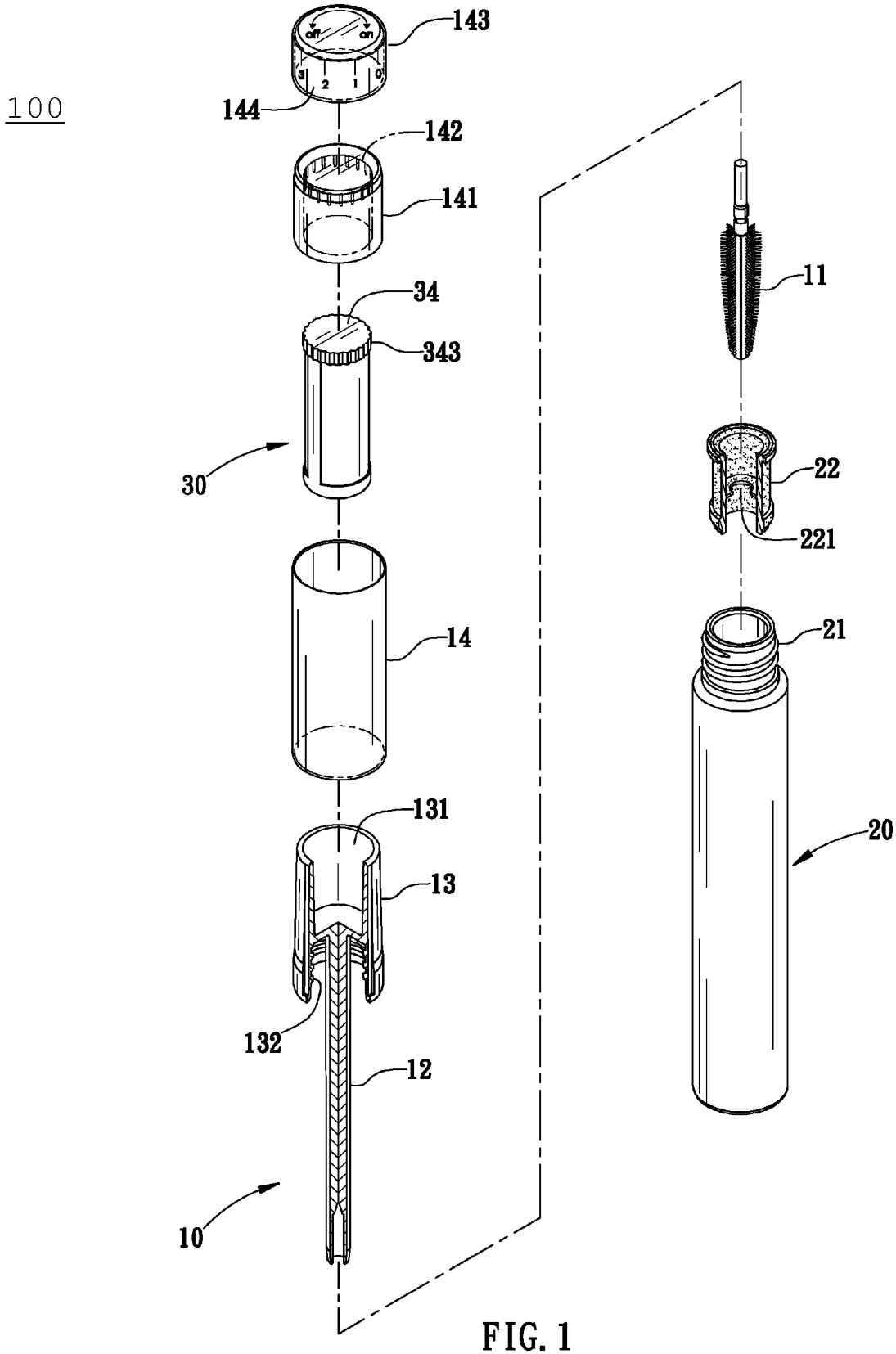
FIG. 1 is an exploding perspective view of one embodiment of an electrical mascara brush structure.

Listing of reference characters used in the drawings:

| | | | |
|---|---|---|---|
| 10 | wand applicator | 11 | brush |
| 12 | wand | 13 | wand base |
| 131 | base chamber | 132 | base inner groove section |
| 14 and 14' | handle | 141 | top |
| 141' | padding | 142 | inner teeth ring |
| 143 | cover | 144 | switch indicator |
| 20 | container | 21 | outer groove section |
| 22 | strainer | 221 | strainer opening |
| 30 | electrical motion component | 301 | first shell |
| 302 | second shell | 303 | shell bottom |
| 304 | shell top | 3041 | second divider |
| 3042 | stopper | 3043 | recess |
| 305 | first divider | 3051 | first chamber |

-continued

| | | | |
|---|---|---|---|
| 306 | fixing plate | 3061 | second chamber |
| 307 | second plate | 3071 | slot groove |
| 3072 | recess opening | 3073 | third chamber |
| 308 | matching second plate | 309 | receiving opening |
| 310 | mounting boss | 31 | motor |
| 311 | rotary shaft | 312 | vibrating piece |
| 32 | power supply | 33 | circuit board |
| 331 | power control element | 332 | speed control element |
| 333 | opening | 334 | conducting plate |
| 34 | rotary unit | 341 | shaft |
| 342 | protruding stopper | 343 | external teeth ring |
| 40 | electrical motion component | 401 | first shell |
| 402 | second shell | 403 | first chamber |
| 404 | second chamber | 405 | third chamber |
| 406 | fourth chamber | 41 | motor |
| 42 | power supply | 421 | first conducting unit |
| 43 | circuit board | 431 | second conducting unit |
| 44 | button | | |

Figure 2:
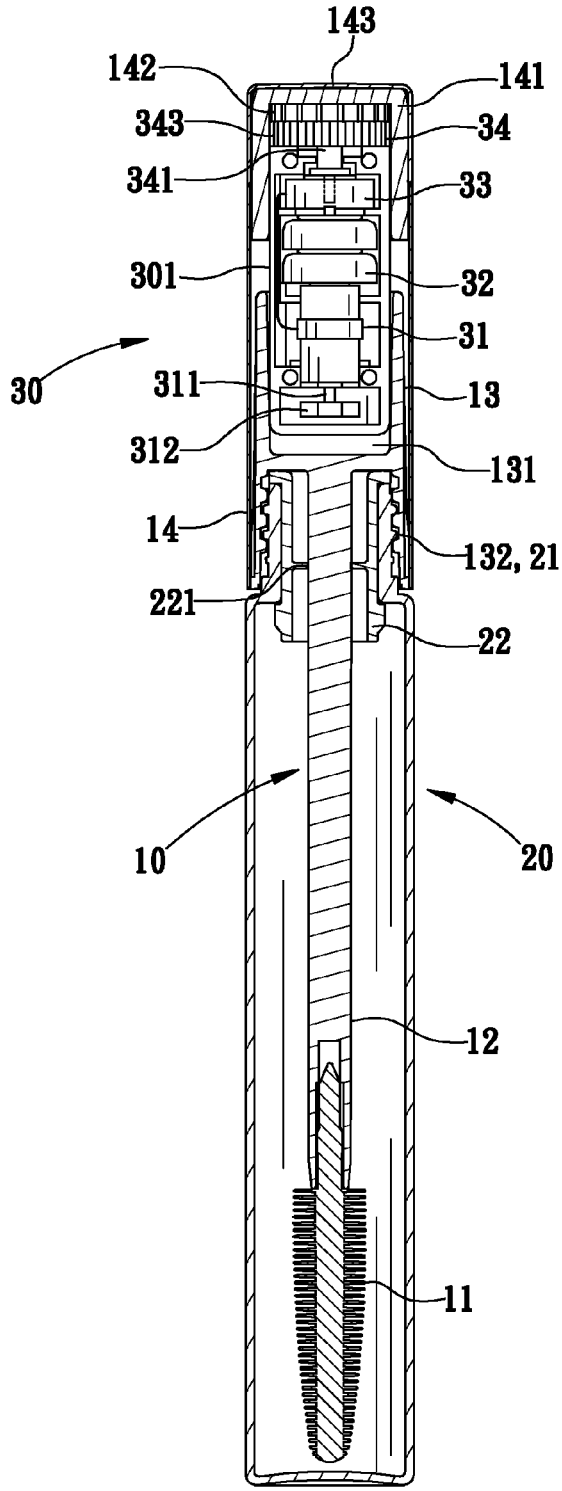
FIG. 2 is a cross-sectional view of an assembled electrical mascara brush structure according to an embodiment of the invention.

Referring now to FIG. 1, an exploding perspective view illustrating one embodiment of an electrical mascara brush structure 100, and FIG. 2, a cross-sectional view of an assembled electrical mascara brush structure 100 according to an embodiment of the invention. The electrical mascara brush structure 100 includes a wand applicator 10 having a brush 11, a wand 12 and a container 20. In one embodiment, the brush 11 is fitted into one end of the wand 12 using known fastening means. For example, the brush 11 may be glued to one end of the wand 12. In another embodiment, the brush 11 may be inserted to the one end of the wand 12 and be fastened such that other types of brushes may be used when the brush 11 needs to be replaced. In another embodiment, the brush 11 may be made of various materials with varying shapes and designs. A wand base 13 is disposed at the other end of the wand 12. In one embodiment, the wand base 13 and wand 12 is made of one integrated or extruded piece of material, as shown in FIG. 2. In one embodiment, the wand base 13 provides a base chamber 131 and a base inner groove section 132. The base chamber 131 creates a space for receiving an electrical motion component 30, having a seat and a wall created by the base chamber 131. In one example, the wand base 13 is cylindrical in shape with a radius near the base inner groove section 132 larger than the radius at the brim of the base chamber 131. The electrical motion component 30 sits within the base chamber 131, as illustrated in FIGS. 1 and 2. In one embodiment, the height of the wall of the base chamber 131 is less than the entire height of the electrical motion component 30.

In one embodiment, the base inner groove section 132 includes grooves or teeth that correspondingly match with an outer groove section 21 of the container 20. In one example, the container 20 holds cosmetic fluid, such as mascara. Other types of cosmetic fluid may be included in the container without departing from aspects and scope of embodiments of the invention. A strainer 22 is disposed at or near the opening of the container 20. In one example, the wand 12 may be screwed on or fastened onto the container 20 as the base inner groove section 132 rotate about the outer groove section 21. In this embodiment, the electrical motion component 30 is not activated or deactivated in response to the loosening or fastening of the wand 12 with respect to the container 20. The strainer 22 includes a strainer opening 221 such that, as the wand 12 is inserted into or withdrawn from the container 20 through the strainer opening 221 of the strainer 22, the brush 11 is brushed or rubbed against the wall of the strainer opening 221 to remove excessive cosmetic fluid. In another embodiment, the diameter of the strainer 20 is tightly fitted to the inner diameter of the outer groove section 21.

Figure 3:
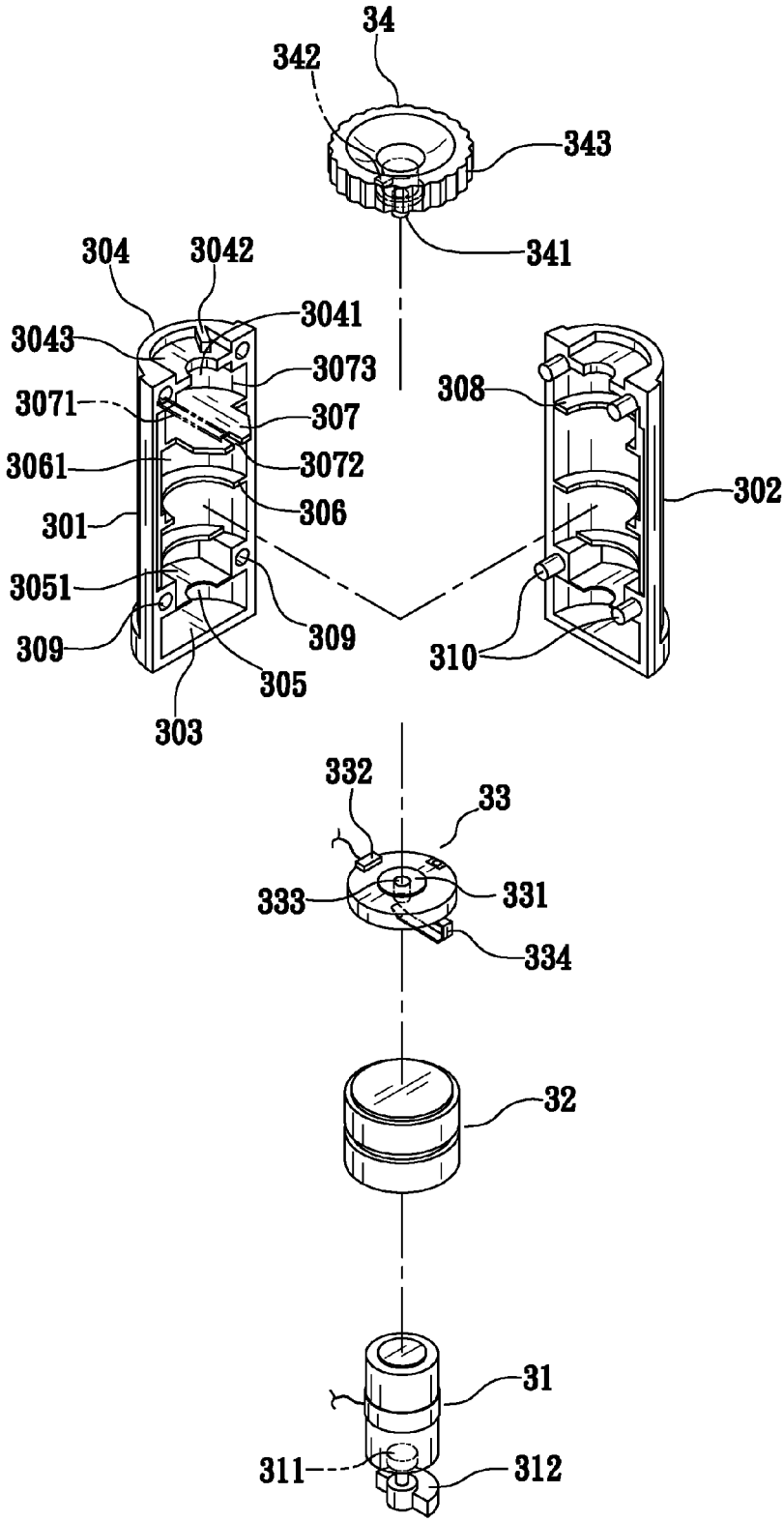
FIG. 3 is an exploding perspective view of an electrical motion component of the electrical mascara brush structure according to an embodiment of the invention.

Referring now to FIG. 3, an exploding perspective view illustrates an embodiment of the electrical motion component 30 of the electrical mascara brush structure according to an embodiment of the invention. As previously described above, the electrical motion component 30 fits within or sits on the base chamber 131 of the wand base 13. In one embodiment, the electrical motion component 30 fits tightly within the base chamber 131 of the wand base 13. In one embodiment, the electrical motion component 30 includes a motor 31, a power supply 32 and a circuit board 33 to form an electrical loop system. In one example, the motor 31 may be a 3 volts motor at a current of 45 mA with a rotational speed of 14,000+/−1000 revolution per minute (RPM). In another embodiment, the motor 31 is observed to be capable of producing at least the following speeds without changing speeds between the levels during testing:

TABLE 1 speed test 1

| Speed level | Approx. average vibration time (hour) | Approx. frequency (Hz) | Approx. revolution per minute |
|---|---|---|---|
| 1 (low) | 3 | 10 | 8800 |
| 2 (mid) | 2 | 32 | 10000 |
| 3 (high) | 1 | 55 | 12000 |

TABLE 2 speed test 2

| Speed level | Approx. average vibration time (h:m:s) | Approx. frequency (Hz) | Approx. revolution per minute |
|---|---|---|---|
| 1 | 3:08:21 | 10 | 8800 |
| 2 | 1:40:35 | Not observed | 9540 |
| 3 | 1:14:55 | Not observed | 10040 |
| 4 | 1:08:27 | 55 | 12300 |

As such, it is to be understood that other motors capable of producing variable speeds with similar power requirements may be used without departing from the scope of embodiments of the invention.

In another embodiment, the electrical motion component 30 is enclosed within a first shell 301 and a second shell 302 to prevent or avoid movement, caused by the motor 31, of the power supply 32 and the circuit board 33 to move away or stray away from the original positions of the power supply 32 and the circuit board 33. In one embodiment, the first shell 301 and the second shell 302 are fitted together to form an enclosed cylinder (to be further explained in detail below) to fully or completely house the motor 31, the power supply 32, and the circuit board 33. There is no extension of the motor or any part thereof that extends to the shaft of the wand 12. In one embodiment, the motor 31 is an electrical motor. In another embodiment, the power supply 32 may be a battery. For example, the power supply 32 may be one or more AG9 button batteries. For example, two LR936 alkaline 1.5 volts batteries, each having a size of 9.5 mm×3.6 mm, may be used as the power supply 32 to energize the 3 volts motor as described above.

For example and as illustrated in FIGS. 1 and 3 without limitations, the circuit board 33 is placed on top of the power supply 32 and the power supply 32 is placed on top of the motor 31. By using the first shell 301 and the second shell 302, the motor 31, the power supply 32, and the circuit board 33 are held in the proper position within the space created by matching the first shell 301 and the second shell 302, by, for example, fitting mounting bosses 310 on the second shell 302 to receiving openings 309 on the first shell 301. It is to be understood other type of fasteners, such as push-on fasteners, may be used to fasten the first shell 301 and the second shell 302.

In particular, each (the first shell 301 or the second shell 302) of the two shells forms a matching half of a hollow cylindrical tube with a shell bottom 303 and a shell top 304. As such, the first shell 301 and the second shell 302, which present the walls of the cylinder, and the shell bottom 303 and the shell top 304 form a enclosure to house the electrical motion component 30. Within the first shell 301, multiple dividers are provided, with matching dividers on the second shell 302, to divide the placement of elements of the electrical motion component 30. For example, a first divider 305 includes a semi-circle opening with a diameter that is the same size or is substantially the same size of a rotary shaft 311 of the motor 31. A fixing plate 306 and the first divider 305 creates a first chamber 3051 to house the motor 31. In particular, the rotary shaft 311 of the motor 31 extends through the opening of the first divider 305 such that the rotary shaft 311 of the motor 31 protrude to the outside of the first chamber 3051 once the first shell 301 and the second shell 302 are enclosed and mapped/matched to each other.

Still referring to FIG. 3, a second plate 307 on the first shell 301 and a matching second plate 302 on the second shell 302 form a round disc as the first shell 301 and the second shell 302 are enclosed and mapped/matched to each other. The round disc formed by the second plate 307 and the matching second plate 308 forms a second chamber 3061 in the enclosed first shell 301 and the second shell 302. In one embodiment, the second chamber 3061 houses the power supply 32.

In one embodiment, the circuit board 33 is housed within a third chamber 3073 formed or created by the second plate 307 and the shell top 304. In this embodiment, the second plate 307 includes a slot groove 3071. Along the length of the slot groove 3071, a recess opening 3072 is set for the placement of the circuit board 33 (to be discussed in further detail below). Other designs of the circuit board 33 may be used and a corresponding design of the third chamber 3073 may be created without departing from the scope of the invention. It is to be understood that these dividers may be placed on the second shell 302 with the matching dividers on the first shell 301 without departing from the scope of embodiments of the invention. In one embodiment, the shell top 304 is disposed near a top edge of the first shell 301 to create a recess 3043 for part of a rotary unit 34. In such an embodiment, the shell top 34 also includes a second divider 3041 having a semi-circle opening. The second divider 3041 also includes a stopper 3042 disposed at a top surface of the second divider 3041 and affixed to the rim of the first shell 301.

In one embodiment, the power supply 32 may include a battery or batteries, positioned either in series or in parallel, to provide electrical energy to the motor 31. With the electrical energy, the motor 31 causes the rotation of the rotary shaft 311. In another embodiment, the circuit board 33 includes a power control element 331 and a speed control element 332 to provide at least the functions of activating the motor 31 and actuating or controlling the speed of the motor 31. In one embodiment, the speed control element 332 may be set to adjust or actuate variable speeds, such as the different speeds shown above in Table 1 and Table 2. In one embodiment, the speed control element 332 includes an opening 333 to receive a shaft 341 of the rotary unit 32. For example, as previously described, the shell top 304 is disposed near the top edge of the first shell 301 to create the recess 3043 for part of the rotary unit 34. In addition, the shell top 34 includes the second divider 3041 having a semi-circle opening. The shaft 341 of the rotary unit 34 extends through the semi-circle opening to come in contact with the opening 333. In one embodiment, the diameter of the semi-circle opening of the second divider 3041 is the same or substantially the same as the diameter of the shaft 341. In another embodiment, the shaft 341 tightly fits into the opening 333.

Also, the circuit board 33 includes a conducting plate 334 which fits into the slot groove 3071 through the recess opening 3072 such that the conducting plate 334 comes in direct contact with the power supply 32. In one embodiment, the conducting plate 334 is a flexible metallic material for facilitating the passage of electrons between the circuit board 33 and the power supply 32. The shaft 341 also includes a protruding stopper 342. As the rotary unit 34 is turned or rotated, the protruding stopper 342 can rotate in the recess 3043 on the surface of the shell top 304. In one embodiment, because of the stopper 3042, the rotary unit 34 cannot be rotated about the axis in 360 degrees as the movement of the protruding stopper 342 is restricted by the stopper 3042. In one embodiment, the angle between the stopper 3042 and the rim of the first shell 301 may be less than 90 degrees. In another embodiment, other stoppers may be positioned on the shell top 304 such that as the user may feel a resistance of movement of the rotating unit 34 as the user rotates the rotary unit 34 to an "OFF" position.

In one embodiment, a vibrating piece 312 is disposed at one end of the rotary shaft 311 of the motor 31. As the motor 31 is energized, with the imbalance caused by the weight distribution of the vibrating piece 312 disposed at the one end of the rotary shaft 311, the vibration caused by the motor 31 will be distributed to the first shell 301 and the second shell 302 as the first shell 301 and the second shell 302 enclose the motor 31 therein. This vibration further distributes to the wand 12 or the wand shaft and thus the brush 11. As such, bristles of the brush 11 will also being to vibrate in response to the vibration distributed from the motor 31. However, because the rotary shaft 311 of the motor 31 does not come in direct contact with the wand 12, the degree of vibration is subtle and not noticeable to the user. Until other electrical wands where a shaft of the motor comes in direct contact with the wand, the wand would vibrate violently, thus causing the user to apply mascara steadily.

In another embodiment, the handle 14 further encloses the first shell 301 and the second shell 302 therein. The length of the handle 14 completely covers the length of the electrical motion component 30 as it sits within the base chamber 131. In one embodiment, one end of the handle 14 along the length meets the bottom of the external wall of the wand base 13 and the other end of the handle 14 meets a bottom edge of a top 141. In one embodiment, the top 141 is a cylindrical tube with a top with hollow space inside. In this embodiment, in the inner diameter of the top 141, an inner teeth ring 142 whose teeth matches the teeth of an external teeth ring 343 of the rotary unit 34. In one example, the external teeth ring 343 may be a textured surface with a matching textured surface of the inner teeth ring 142. As such, a rotation of the top 141 causes a corresponding rotation of the rotary unit 34. In another embodiment, a cover 143 is further domed on the exterior of the top 141 with a switch indicator 144. In one embodiment, the cover 143 completes cover the exterior of the top 141. For example, the cover 143 may include a marking showing a direction of "ON" and "OFF" to indicate how to energize the electrical mascara brush structure 100. In another embodiment, on the cylindrical surface of the cover 143, the switch indicator 144 may also include markings showing various speed variations of the motor 31. For example, the switch indicator 144 may show markings, such as "0," "1," "2," and "3" with "0" corresponding to the slowest speed or zero speed and "3" corresponding to the fastest speed. In one embodiment, at speed "0", the electrical mascara brush structure 100 is still in the "ON" position and the motor 31 is in the energized state. In one embodiment, the cover 143 may be textured so as to enable the user to distinguish over the handle and the cover 143 which enables the user to active/energize the electrical mascara brush structure 100. Other markings or speed variations may be used without departing from the scope of embodiments of the invention. As such, once the electrical motion component 30 is in a particular state (e.g., "ON," or "OFF") or the motor is at a particular speed setting (e.g., "1—low speed," "2—mid speed," or "3—high speed"), the electrical motion component 30 will maintain in the particular state or the particular speed setting without the user to continuously hold the cover 143 in the particular position indicated by the switch indicator 144. In other words, unlike some existing technologies where the user is required to hold the switch for the motor to be energized, aspects of the invention relieve the user's finger of this burden, enabling the user to switch fingers, switch hands, finger placements on the cover and the handle or do other hand maneuvers without requiring one particular finger to exert force dedicated to the switch at a particular position.

Figure 4:
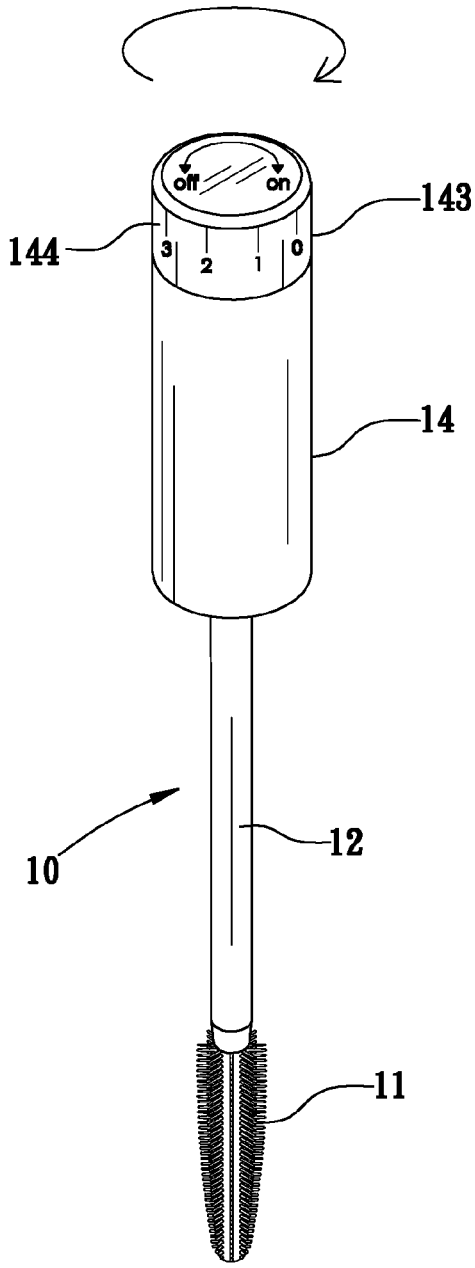
FIG. 4 is a perspective view of an assembled wand applicator of the electrical mascara brush structure according to an embodiment of the invention.

Referring now to FIG. 4, perspective view illustrates an assembled wand applicator of the electrical mascara brush structure according to an embodiment of the invention. In operation, to energize the electrical mascara brush structure 100, which is initially in an "OFF" state, a user may first remove the wand applicator 10 from the container 20. This removal of the wand applicator 10 from the container 20 does not activate or energize the electrical motion component 30, as taught by some existing technology. The user may hold the wand applicator 10 by the handle 14 using one two fingers of one hand. The user may use another finger to rotate the cover 143, which in terms causes a corresponding rotation of the top 141. The rotation of the top 141 causes corresponding rotation of the rotary unit 34, which adjusts or actuates the circuit board 33 to be in an "ON" state. As such, the electrical energy from the power supply 32 energizes the motor 31. The motor 31 causes a rotation of the rotary shaft 34 and, with the vibrating piece 312 attached to the rotary shaft 34, the electrical motion component 30 vibrates. This vibration also causes the vibration of the first shell 301, the second shell 302 and the wand base 13. As the wand 12 is integrally formed with the wand base 13, the vibration from the motor also causes the vibration of the wand 12 and the brush 11 attached thereto. As such, the user may hold the wand applicator 10 to an appropriate position near the user's eyelashes to apply the mascara while the wand 12 does not vibrate violently. In another example, the user may also further rotate the cover 143 to adjust the speed of the motor 31 to either intensify or lessen the vibration of the wand 12 during the application.

Unlike existing one-speed electrical wand applicators, aspects of the invention overcome such a disadvantage of the single speed device because mascara can be a thick fluid with high viscosity. A single speed vibration may sometimes take long to dissipate clumps of mascara throughout the eyelashes. By having the variable speeds in combination with the rotating control of the top 141 (which acts as a switch), the user can easily adjust the speed during application such that even distribution of the mascara on the eyelashes can be achieved in a timely manner.

In addition, aspects of the invention provide improvements over electrical wand applicators that require the user to continuously hold the switch for the wand to be energized. Aspects of the invention do not require the user constantly hold the top 141 in a particular speed position; the motor 31 will be energized as controlled by the speed control element 332 of the circuit board 33 so that the user can switch hands if necessary during application without switching the applicator "OFF".

Figure 5:
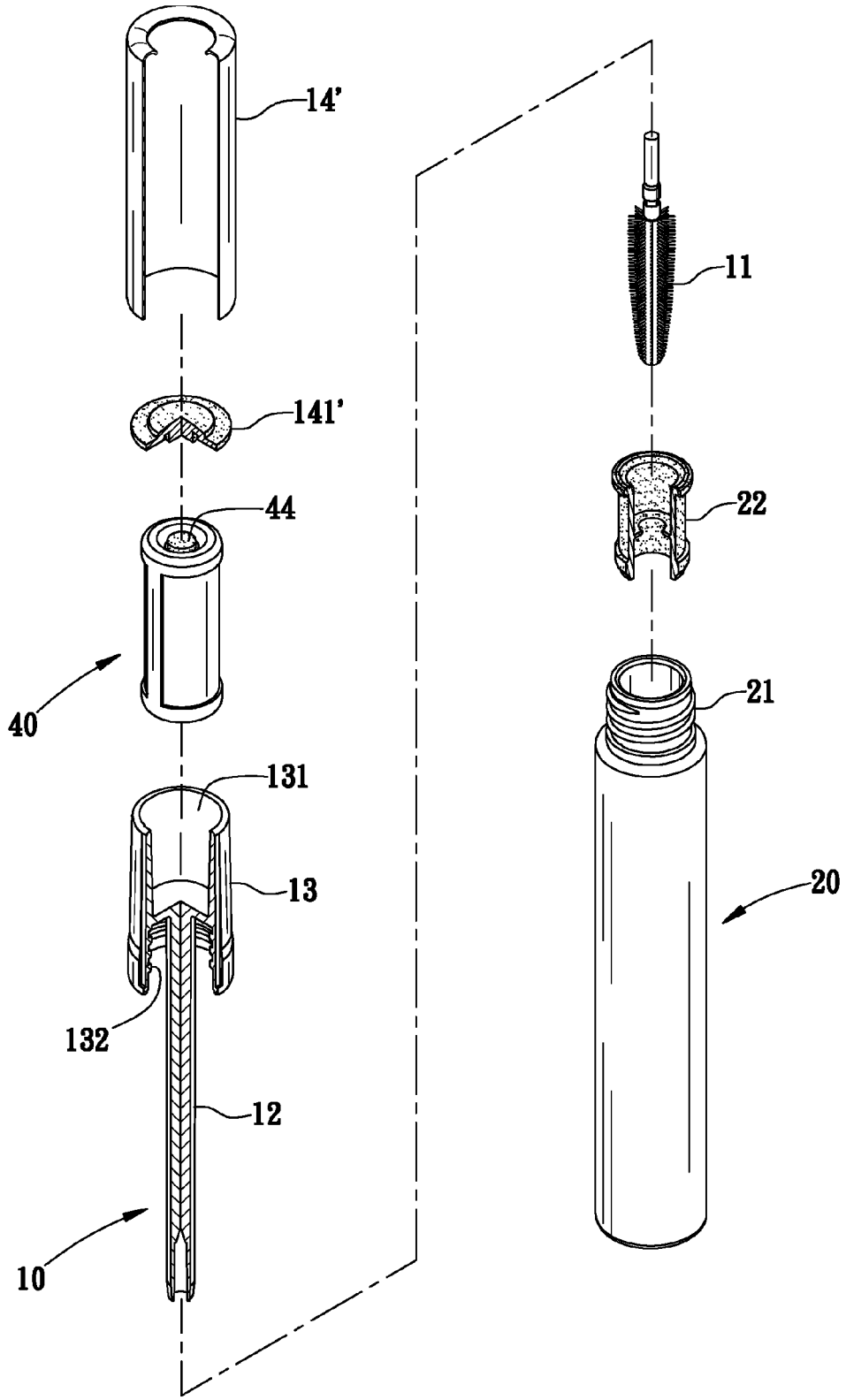
FIG. 5 is an exploding perspective view of an electrical mascara brush structure according another embodiment of the invention.
Figure 6:
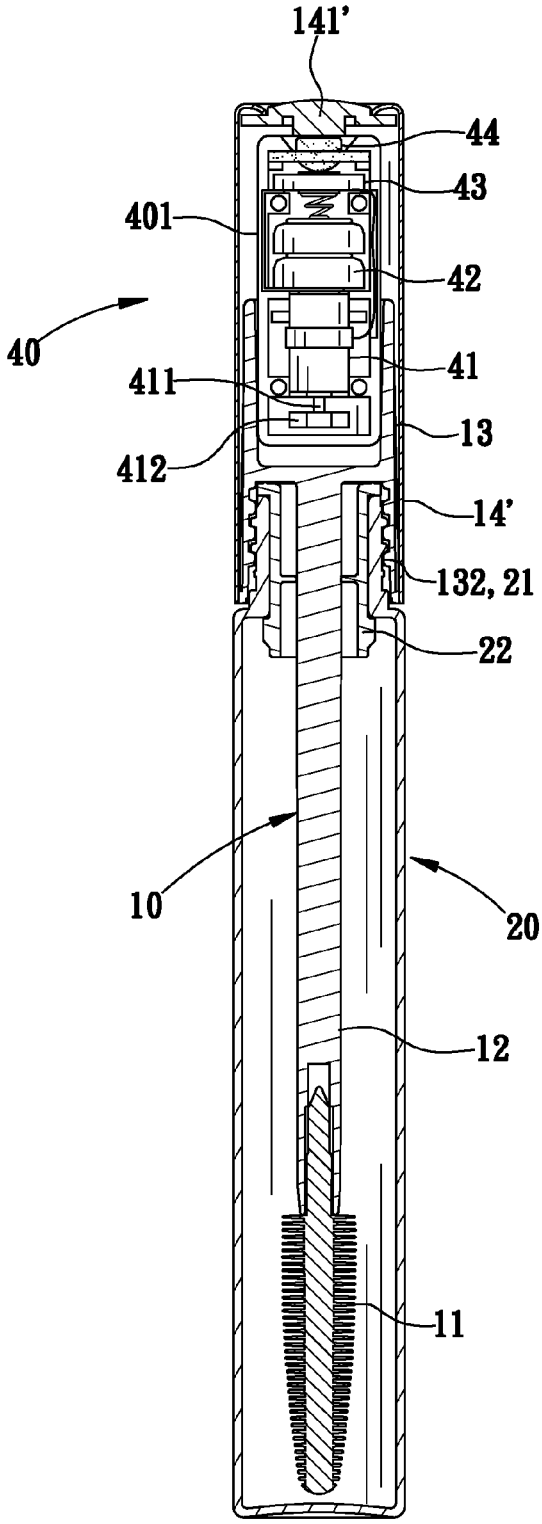
FIG. 6 is a cross-sectional view of the electrical mascara brush structure according to the embodiment of the invention as shown in FIG. 5.
Figure 7:
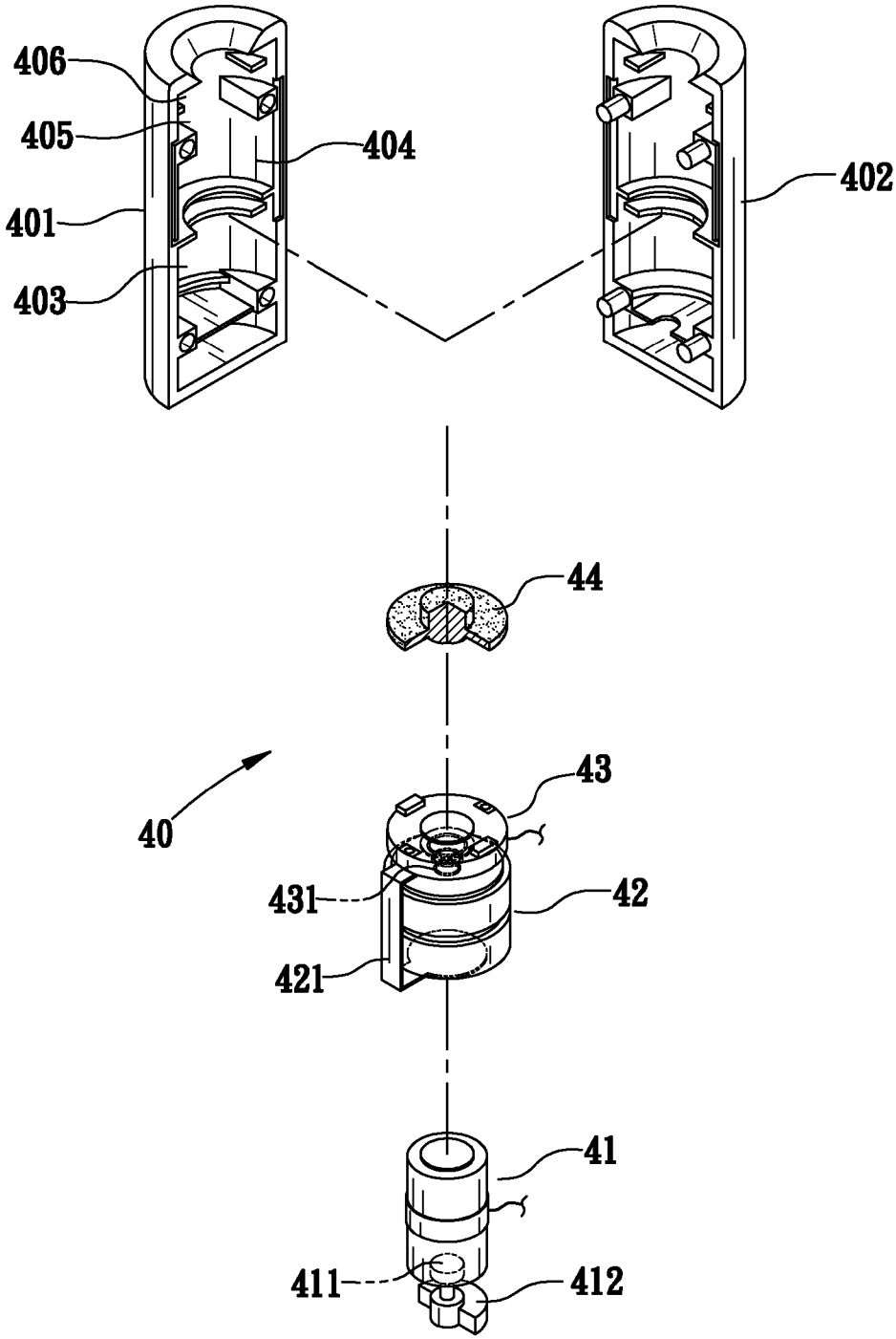
FIG. 7 is an exploding perspective view of an electrical motion component of the electrical mascara brush structure according to the embodiment of the invention as shown in FIG. 5.
Figure 8:
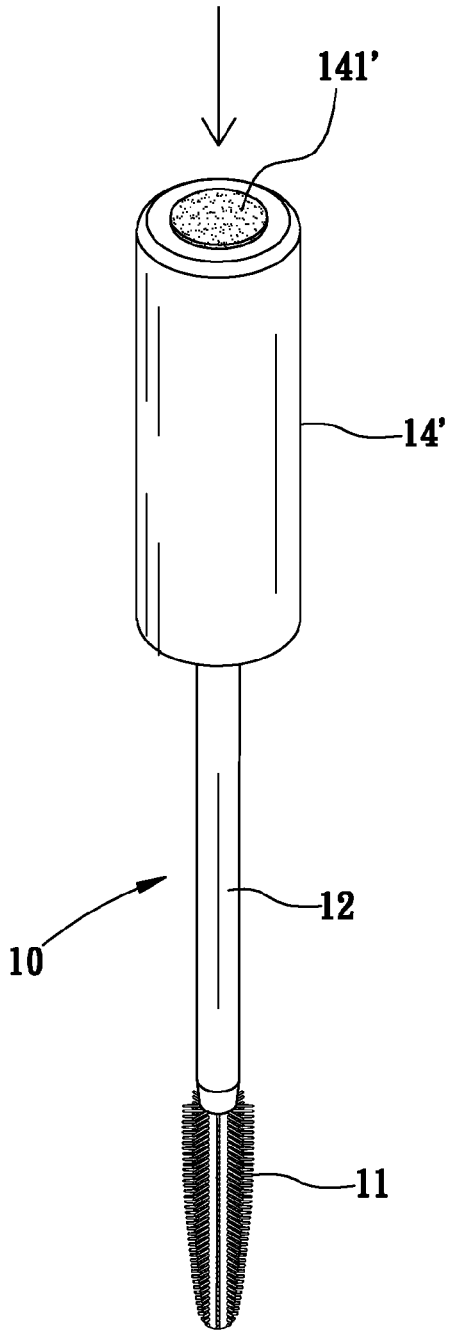
FIG. 8 is a perspective view of an assembled wand applicator of the electrical mascara brush structure according to the embodiment of the invention as shown in FIG. 5.

Referring now to FIGS. 5-8, a series of figures showing another embodiment of the invention. For example, FIG. 5 is an exploding perspective view of an electrical mascara brush structure according another embodiment of the invention. In this embodiment, an electrical motion component 40 includes a motor 41, a power supply 42 and a circuit board 43. A first conducting unit 421 and a second conducting unit 431 are disposed between the power supply 42 and the circuit board 43. In one embodiment, the first conducting unit 421 or the second conducting unit 431 may be an electrical conducting plate or a metallic spring. This embodiment also includes a first shell 401 and a second shell 402 to enclose the electrical motion component 40 therein. The enclosed space created by fitting the first shell 401 and the second shell 402 (similar to that of the first shell 301 and the second shell 302) together enables the creation of a first chamber 403 for housing the motor 31, a second chamber 404 for housing the power supply 42, a third chamber for housing the circuit board 43, and a fourth chamber 405, as shown in FIG. 7. In this embodiment, a button 44 is used to be in direct contact with the circuit board 43 and is disposed partially in the fourth chamber 405 and partially exposed to the exterior of the first shell 401 and the second shell 402 such that a user's finger can depress the button 44. Referring now to FIG. 8, a padding 141' is placed on the surface of the button 44. As such, a user may use his or her fingers to hold a handle 14' of this embodiment and depress the padding 141' to energize the motor 41.

In this embodiment, the button 44 may enable the motor 41 to be in the following states starting from an "OFF" state as the initial state:

The first depression of the button energizes the motor 41 to enter into an

"ON" or energized state and directly actuates the motor 41 to be in a slow speed state;

The second depression of the button energizes the motor 41 to be in a mid speed state;

The third depression of the button energizes the motor 41 to be in a high speed state; and The fourth depression of the button de-energizes the motor 41 and transitions to the "OFF" state.

Other states may be included, depending on the number of available speeds, without departing from the scope of embodiments of the invention.

In operation, a user may use the embodiment shown in FIGS. 1-4 or the embodiment shown in FIGS. 5-8 to apply the cosmetic fluid (e.g., mascara) to the user. In the example of mascara, the user may first untwist the wand applicator from the container and the brush will first brush against the bristles to remove excessive mascara from the bristles. The user may next turn on the electrical motion component by turning the top to activate or energize the electrical motion component. In the embodiment shown in FIGS. 5-8, the user may depress the button once to activate the electrical motion component. The user may further adjust the speed of the electrical motion component to a desirable speed by turning the top in a direction show according to the switch indicator (as shown in FIG. 4) or by depressing the button additional times. The electrical motion component keeps the motor activated in the particular speed based on the user's preference, and the user's hands are free from continuously holding the top or pressing the button. Once the user is completed with the application of mascara, the user may turn off the electrical motion component by turning to the off position (according to the switch indicator) or pressing the button. If the user wishes to have more mascara to be included on the bristles, the user can return the wand to the container and repeat the process again. Once the application is completed, the user may return the wand back to the container and twist close the wand applicator.

Although the invention has been explained in relation to its various embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

Having described the invention in detail, it will be apparent that modifications and variations are possible without departing from the scope of the invention defined in the appended claims.

When introducing elements of the embodiments(s) of the present invention, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions or products without departing from the scope of the invention, it is intended that all matter contained in the above description and shown in the accompanying drawing[s] shall be interpreted as illustrative and not in a limiting sense.

What is claimed is:

1. An electrical mascara brush structure, comprising:

a wand applicator, said wand applicator including a wand base and a brush end, said wand base including a chamber for housing an electrical motion component, said brush end including a brush at a distal end of the brush end, said electrical motion component being enclosed in two correspondingly sized semi-circle cylindrical shells and being seated in the included chamber of the wand base, said two correspondingly sized semi-circle cylindrical shells and the wand base being enclosed at least partially in a handle, said electrical motion component having a motor with a rotary shaft, a power supply connected to the motor, and a circuit board connected to the power supply, said semi-circle cylindrical shells forming a first chamber for housing the motor, a second chamber for housing the power supply, and a third chamber for housing the circuit board, said first chamber being adjacent to the wand base and being positioned underneath the second chamber, said second chamber being positioned underneath the third chamber, wherein the first chamber, the second chamber and the third chamber are divided by one or more dividers;

a rotary unit, being disposed at an exterior of the semi-circle cylindrical shells, including a shaft extending through an opening of the semi-circle cylindrical shells, said shaft being fitted into a correspondingly receiving opening of the circuit board, the circuit board further comprising a flexible conducting plate for establishing an electrically conducting contact with the power supply, said flexible conducting plate being disposed at a slot groove of one of the one or more dividers, said rotary unit further comprising a textured surface on an exterior surface of the rotary unit; and a top unit for covering the rotary unit, said top unit including an inner ring in an interior surface thereof, said inner ring including another textured surface for matching the textured surface of the rotary unit, wherein a rotation of the top unit about an axis causes actuating of the circuit board to energize the motor and to adjust a speed of the motor.

2. The structure of claim 1, wherein the circuit board comprises a power control element and a speed control element, wherein a rotation of the rotary unit actuates variable speeds of the motor.

3. The structure of claim 1, wherein the handle comprises markings for controlling the motor, said markings including at least the following: OFF, low speed, medium speed and high speed.

4. The structure of claim 1, wherein the shaft of the rotary unit comprises a protruding stopper, said protruding stopper being rotated about the axis in response to the rotation of the top unit about the axis, wherein one of the two correspondingly sized semi-circle cylindrical shells includes a stopper for restricting a movement of the protruding stopper.

5. The structure of claim 1, wherein the two correspondingly sized semi-circle cylindrical shells comprise matching mounting bosses and correspondingly receiving openings.

6. The structure of claim 1, wherein the rotary shaft of the motor comprises a vibrating piece.

7. The structure of claim 1, further comprising a container with fastening grooves disposed at a brim of the container, wherein the wand base comprises another fastening grooves matching the fastening grooves of the container such that the brush end is placed within the container as the wand base is fastened to the container.

8. An electrical mascara brush structure, comprising:

a wand applicator, said wand applicator including a wand base and a brush end, said wand base including a chamber for housing an electrical motion component, said brush end including a brush at a distal end of the brush end, said electrical motion component being enclosed in two correspondingly sized semi-circle cylindrical shells and being seated in the included chamber of the wand base, said two correspondingly sized semi-circle cylindrical shells and the wand base being enclosed at least partially in a handle, said electrical motion component having a motor with a rotary shaft, a power supply connected to the motor, and a circuit board connected to the power supply, said circuit board including a power control element and a speed control element, said semi-circle cylindrical shells forming a first chamber for housing the motor, a second chamber for housing the power supply, and a third chamber for housing the circuit board, said first chamber being adjacent to the wand base and being positioned underneath the second chamber, said second chamber being positioned underneath the third chamber, wherein the first chamber, the second chamber and the third chamber are divided by one or more dividers;

a rotary unit, being disposed at an exterior of the semi-circle cylindrical shells, including a shaft extending through an opening of the semi-circle cylindrical shells, said shaft being fitted into a correspondingly receiving opening of the circuit board, the circuit board further comprising a flexible conducting plate for establishing an electrically conducting contact with the power supply, said flexible conducting plate being disposed at a slot groove of one of the one or more dividers, said rotary unit further comprising a textured surface on an exterior surface of the rotary unit; and a top unit for covering the rotary unit, said top unit including an inner ring in an interior surface thereof, said inner ring including another textured surface for matching the textured surface of the rotary unit, wherein a rotation of the top unit about an axis causes actuating of the circuit board to energize the motor and to adjust a speed of the motor.

9. The structure of claim 8, wherein the handle comprises markings for controlling the motor, said markings including at least the following: OFF, low speed, medium speed and high speed.

10. The structure of claim 8, wherein the shaft of the rotary unit comprises a protruding stopper, said protruding stopper being rotated about the axis in response to the rotation of the top unit about the axis, wherein one of the two correspondingly sized semi-circle cylindrical shells includes a stopper for restricting a movement of the protruding stopper.

11. The structure of claim 8, wherein the two correspondingly sized semi-circle cylindrical shells comprise matching mounting bosses and correspondingly receiving openings.

12. The structure of claim 8, wherein the rotary shaft of the motor comprises a vibrating piece.

13. The structure of claim 8, further comprising a container with fastening grooves disposed at a brim of the container, wherein the wand base comprises another fastening grooves matching the fastening grooves of the container such that the brush end is placed within the container as the wand base is fastened to the container.

14. An electrical mascara brush structure, comprising:

a wand applicator, said wand applicator including a wand base and a brush end, said wand base including a chamber for housing an electrical motion component, said brush end including a brush at a distal end of the brush end, said electrical motion component being enclosed in two correspondingly sized semi-circle cylindrical shells and being seated in the included chamber of the wand base to avoid uncontrolled movements of parts of the electrical motion component, said two correspondingly sized semi-circle cylindrical shells and the wand base being enclosed at least partially in a handle, said electrical motion component having a motor with a rotary shaft, a power supply connected to the motor, and a circuit board connected to the power supply to form an electrical loop system, said circuit board including a power control element and a speed control element, said semi-circle cylindrical shells forming a first chamber for housing the motor, a second chamber for housing the power supply, and a third chamber for housing the circuit board, said first chamber being adjacent to the wand base and being positioned underneath the second chamber, said second chamber being positioned underneath the third chamber, wherein the first chamber, the second chamber and the third chamber are divided by one or more dividers;

a rotary unit, being disposed at an exterior of the semi-circle cylindrical shells, including a shaft extending through an opening of the semi-circle cylindrical shells, said shaft being fitted into a correspondingly receiving opening of the circuit board, the circuit board further comprising a flexible conducting plate for establishing an electrically conducting contact with the power supply, said flexible conducting plate being disposed at a slot groove of one of the one or more dividers, said rotary unit further comprising a textured surface on an exterior surface of the rotary unit, said shaft of the rotary unit comprising a protruding stopper, said protruding stopper being rotated about the axis in response to the rotation of the top unit about the axis, wherein one of the two correspondingly sized semi-circle cylindrical shells includes a stopper for restricting a movement of the protruding stopper, and a top unit for covering the rotary unit, said top unit including an inner ring in an interior surface thereof, said inner ring including another textured surface for matching the textured surface of the rotary unit, wherein the circuit board, the power supply and the motor form an electrical circuit in series, and wherein the electrical circuit is a close circuit as flexible conducting plate is connected with the power supply, wherein a rotation of the top unit about an axis causes actuating of the circuit board to energize the motor and to adjust a speed of the motor.

15. The structure of claim 14, further comprising a container with fastening grooves disposed at a brim of the container, wherein the wand base comprises another fastening grooves matching the fastening grooves of the container such that the brush end is placed within the container as the wand base is fastened to the container.

16. The structure of claim 15, wherein the brim of the container comprises a strainer, said strainer being disposed at an inner surface of the container, said strainer further including a strainer opening to receive the brush.

17. The structure of claim 14, wherein the two correspondingly sized semi-circle cylindrical shells comprise matching mounting bosses and correspondingly receiving openings.

* * * * *